United States Patent [19]

Dinis et al.

[11] Patent Number: 4,505,081

[45] Date of Patent: Mar. 19, 1985

[54] CURVED DEVICE FOR CONNECTION BETWEEN TWO RECTILINEAR PORTIONS OF A STRETCHED CABLE

[75] Inventors: Antonio Dinis, Noisy le Roi; Carlos de la Fuente, Nanterre; Paul Mondorf, Ville D'Avray, all of France

[73] Assignee: Freyssinet International (STUP), Boulogne-Billancourt, France

[21] Appl. No.: 409,287

[22] Filed: Aug. 18, 1982

[30] Foreign Application Priority Data

Aug. 21, 1981 [FR] France ..... 81 16079

[51] Int. Cl.[3] ..... E04C 3/10

[52] U.S. Cl. ..... 52/223 L; 52/230

[58] Field of Search ..... 52/230, 225, 224, 223 R, 52/223 L; 403/300, 306, 265

[56] References Cited

U.S. PATENT DOCUMENTS

| | | | |
|---|---|---|---|
| 3,225,499 | 12/1965 | Kourkene | 52/230 |
| 3,422,501 | 1/1969 | Yoshimura | 52/230 |
| 3,449,876 | 6/1969 | Howleff | 52/230 |
| 3,676,968 | 7/1972 | Campbell | 52/230 |

FOREIGN PATENT DOCUMENTS

| | | | |
|---|---|---|---|
| 155756 | 3/1954 | Australia | 52/223 R |
| 671697 | 10/1963 | Canada | 52/223 R |
| St 5326 | 9/1956 | Fed. Rep. of Germany | 52/230 |
| 1018607 | 10/1957 | Fed. Rep. of Germany | 52/223 R |
| 2811759 | 9/1979 | Fed. Rep. of Germany | 52/230 |
| 1082708 | 12/1954 | France | 52/223 R |
| 1230559 | 9/1960 | France | 52/223 R |
| 370221 | 8/1963 | Switzerland | 52/230 |

*Primary Examiner*—Carl D. Friedman

*Attorney, Agent, or Firm*—Ned L. Conley; David A. Rose; William E. Shull

[57] ABSTRACT

The invention has for its object a device for connection between two rectilinear portions of a stretched cable, said device passing through a massive constructive work.

According to the invention said device transmits the tension from one of the portions of cable to the other by a segment of cable of which the strands, curved along the desired incurvation, are separated from one another and stretched, with a total tension force at least equal to that of the more stretched of the two portions of cable, to ensure precompression of the portion of massive structure which these strands traverse.

10 Claims, 6 Drawing Figures

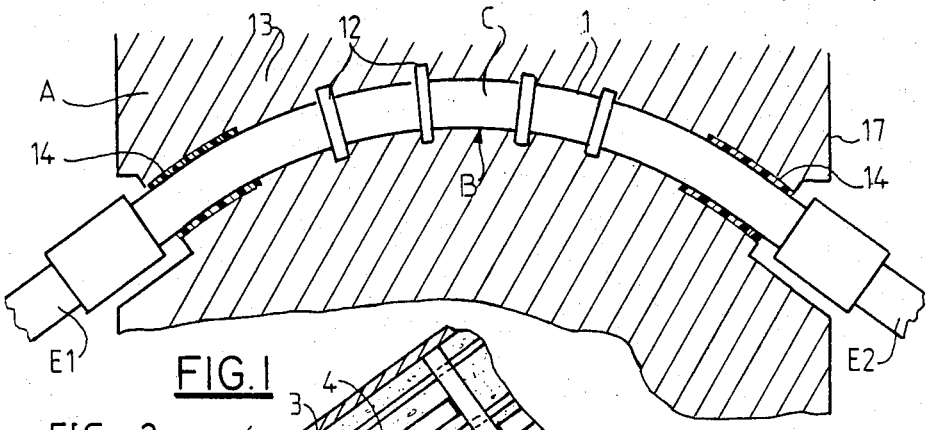
FIG. 1
FIG. 2
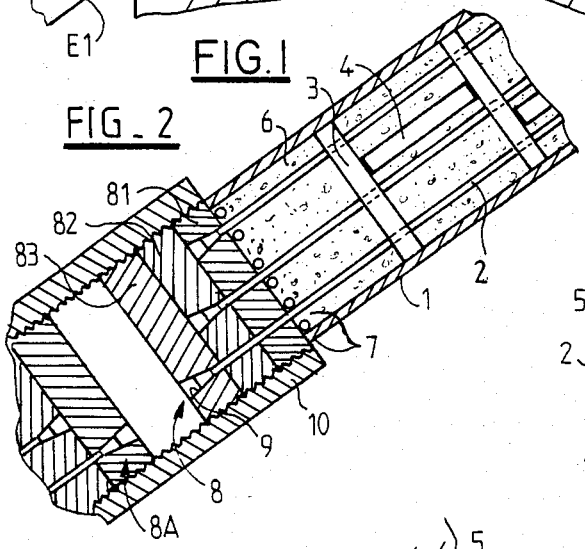
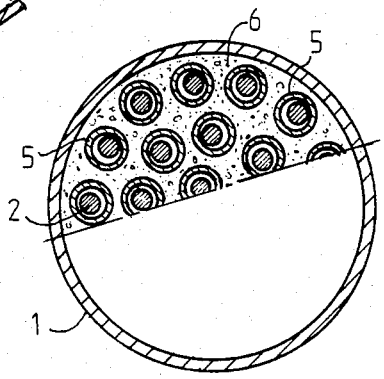
FIG. 3
FIG. 4
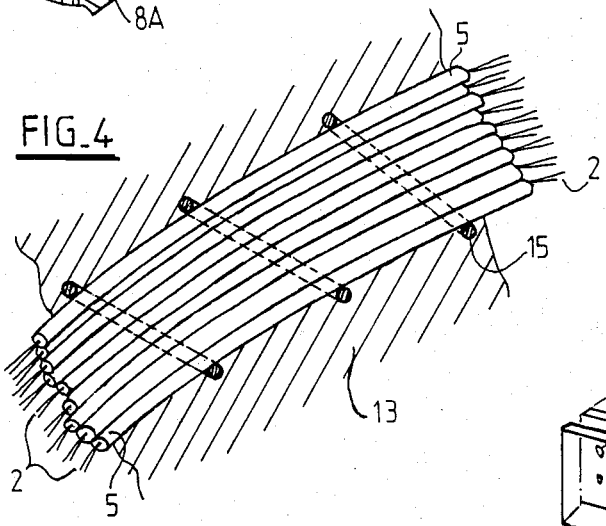
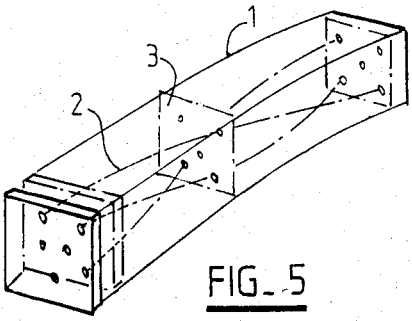
FIG. 5
FIG. 6
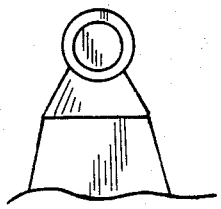

CURVED DEVICE FOR CONNECTION BETWEEN TWO RECTILINEAR PORTIONS OF A STRETCHED CABLE

BACKGROUND OF THE INVENTION

The present invention relates to a curved device for connection between two rectilinear portions of a stretched cable, device ensuring continuity of the tension in the whole of the cable.

It is known that the optimum design of a prestress or staying cable frequently comprises rectilinear portions on either side of a change in direction. To simplify implementation of constructive works, it is advantageous to ensure continuity of the tension along the cable rather than to ensure, by reinforcing means, the connection of partial rectilinear cables intersecting at the change in direction. Such a continuity is particularly desirable in the case of stays bearing a constructive work suspended from a pylon, the two symmetrical stays of the same couple thus being balanced directly at the level of their support on the pylon.

If a continuous multi-strand cable is thus employed, its strands (wires, bars) are, by the tension of the cable, pressed against one another and against the convex portion of the support ensuring deviation of the cable, so that even slight variations in the tension cause reciprocal frictions of these cable strands.

More generally, any relative displacement of a cable strand with respect to a solid with which it is in contact provokes friction and, in the long run, deterioration of this strand, bringing about a considerable reduction in the fatigue resistance.

The curved connecting device according to the invention prevents this type of deterioration.

SUMMARY OF THE INVENTION

According to the invention, the device for connection between two rectilinear portions of a stretched cable, said device passing through a massive constructive work, is characterised in that it transmits the tension from one of the portions of cable to the other by a segment of cable of which the strands, curved to the desired incurvation, are separated from one another and stretched, with a total tension force at least equal to that of the more stretched of the two portions of cable, to ensure pre-compression of the portion of massive structure which these strands traverse.

In a first embodiment of the invention, an element of massive structure, having the desired configuration to receive the strands of the segment of cable, is prefabricated and this element is directly pre-stressed by the strands of cable which it encloses.

In another embodiment, a generally tubular envelope, in which are formed the passages of the curvilinear strands of the cable, is incorporated in the shuttering of the structure and, after the latter is made, said strands are stretched and rendered fast with this structure by anchoring at their inlet and outlet ends, said anchorings abutting on this tubular envelope. In this case, the whole of the portion of structure through which this segment of cable passes is pre-stressed.

Any relative displacement of the strands with respect to the solid bodies in contact therewith is thus avoided. The tubular envelope may or may not adhere to the structure in which it is positioned.

In the absence of adherence, if the variations in tension of the cable are considerable and if the volume and mass of this structure element are reduced, a relative displacement of the ends of the tubular envelope with respect to the rest of the structure may be produced. The effects of this displacement may be overcome by locally arranging slip surfaces or, better, due to a deformable elastic connection (for example one or more layers of elastomer) between the ends of this element and the rest of the structure.

Among the means for carrying out the invention, flexible cylinders each corresponding to a strand of the segment of connecting cable may be used to make a bundle which, for example by being enclosed in an envelope, may be coated and impregnated with setting material to constitute either a stucture element prestressed in advance, before incorporation in this structure, or be incorporated of this structure to be prestressed after setting and hardening of this structure.

These flexible cylinders may be made of elastomers (solid or tubular) and be extracted from the structure element to allow housing of the curved strands. They may also be tubular and allow passage of these strands. The channel having allowed threading is injected after tensioning, the injection material advantageously being a cement grout. Use may also be made of strands individually coated with grease inside a plastic sheath, according to the so-called "greased strand" technique.

Anchoring of the curvilinear strands against the inlet and outlet faces of the structure element may be ensured by the connecting members with the strands of the rectilinear parts of the cable, in an arrangement of the "pre-stress reinforcement coupler" type.

The invention will be more readily understood on reading the following description with reference to the accompanying drawings, in which:

FIG. 1 is a vertical section through a connecting device according to the invention.

FIG. 2 is an enlarged axial section through one of the ends of this device.

FIG. 3 is a transverse section through an embodiment of such a device.

FIG. 4 is a partial view in section of another variant embodiment.

FIG. 5 illustrates, in schematic perspective, a possible variant embodiment.

FIG. 6 schematically shows a particular mode of application of the device.

Referring now to the drawings, FIG. 1 partly shows a pylon A, adapted to support a bridge via stays, and which comprises a superposition of curved channels B of which only one is shown. Each of these channels encloses a connecting device C adapted to ensure continuity of the tension between two rectilinear and summetrical portions of stretched cable $E_1$ and $E_2$ of which each is, in the present case, a stay of the bridge.

As shown in detail in FIG. 2, the device C comprises a curved tube 1 inside which are disposed, in orderly manner, strands of cable 2 maintained in this arrangement (at least) by a succession of separator elements 3 which spacer elements 4 may, if necessary, maintain in position at predetermined distance. As a variant, as shown in FIG. 3, the strands 2, for example strands or wires, may each be threaded in a tube 5, all the tubes 5 being maintained in orderly arrangement by ties or preferably by the enveloping tube 1 of large diameter.

In any case, the free spaces inside the tube 1 are filled with a settable material 6 injected into this tube in the liquid state and which, when solidified, is capable of elastic compression. This material is advantageously a cement mortar.

At the ends of the tube 1, the strands 2 are anchored in blocks 8, in the present case each formed by three thick discs 81, 82, 83 of which each comprises conical cavities 9 for anchoring one third of the number of strands 2; the discs in which the strands are not anchored are traversed thereby in cylindrical bores. It is known that such an arrangement of individual anchorings reduces the diameter of the anchoring block, further limiting the deviation of the strands.

The assembly of the three discs 81, 82, 83 is threaded on the outside to receive a sleeve 10 ensuring connection with a similar anchoring block 8A which terminates each of the two rectilinear portions of stretched cable to be connected.

The assembly thus produced is equipped with nozzles for filling and with vents (not shown); it may further comprise O-rings 7 to allow it to be filled under pressure with the setting liquid material adapted to be compressed with the rest of the contents of the tube by tensioning of the strands 2.

It is possible, the strands 2 being bare, stretched and maintained in place in the (suitably shaped) tube 1 by separator elements 3, virtually adjacent in order to have a regular curvature, to cast cement mortar into this tube so that this mortar, once hardened, is compressed, as well as the tube 1, by the strands 2 released from their tensioning apparatus.

In another configuration, the strands 2 being greased, or sheathed, or housed in individual tubes 5, the material 6 is injected before tensioning of the strands and anchoring in the blocks 8. The total tension imposed on the strands must in any case be at least equal to, and preferably greater than the tension of the portions of cable $E_1$ $E_2$ for a pre-stress to exist in the device in service.

A connecting device thus prepared may be simply applied against a curved support made in the structure, for example an opening in the form of canal made in a pylon, for connecting two stays, or placed at the top of said pylon (FIG. 6).

It may also be incorporated in such a plyon in the manner shown in FIG. 1. The tube 1 may be provided in its central part with welded rings 12 (or other elements in relief) to improve its connection with the mass of concrete 13 of the pylon 17. Towards the ends, the tube 1 is separated from the concrete 13 by a layer of grease or by elastomer sleeves 14. In this way, when there is a variation in tension in the rectilinear portions $E_1$ and $E_2$, the tube 1 and its contents may vary in length (by variation of the tension of the strands and of the compression of the tube and its contents) without affecting the pylon A.

It is also possible to proceed as shown in FIG. 4. The strands 2 enclosed in their individual tubes form a bundle held together by a helix 15 of metal wire. The assembly is incorporated in the shuttering of the pylon which is then covered with concrete. The strands 2 are then stretched and anchored, for example via anchoring plates or blocks, against the lateral faces of the pylon. In this way, the pre-stress is no longer limited to the tubular envelope of the strands but progressively affects the interior of the mass of concrete 13. In this case, the variations in tension of the rectilinear portions of cable thus connected cause no relative displacement of solid elements and, consequently, eliminate any outside cause of deterioration by fatigue of the cable and its accessories.

In the embodiment shown in FIG. 5, the strands 2 are disposed as helix to compensate their differences in length due to the incurvation of the tube 1, in the present case of rectangular cross section. Likewise in this case, the tension of the strands 2 and anchoring thereof are effected after setting the hardening of the concrete which fills the tube 1 and surrounds it.

The invention is applied to all stretched cables presenting inflexions and subjected to an uninterrupted tension. It is especially suitable for continuous couples of suspension stays for a constructive work from one or more pylons.

It is known that such stays, by reason of the circulation of considerable loads, bad weather and variations in temperature, are subject to considerable variations in tension.

What is claimed is:

1. Apparatus for connection between two rectilinear portions of a stretched cable, said apparatus being adapted to pass through a massive constructive work and to transmit tension from one of said portions of stretched cable to the other, said apparatus comprising said two rectilinear portions of a stretched cable, a segment of cable disposed between and interconnecting said two rectilinear cable portions, said segment of cable including a prestressed outer tubular envelope containing a plurality of cable strands, said outer tubular envelope being filled, at least partly, with a hardened cemetitious material, said strands being separated from one another and stretched with a total tension force at least equal to that of the more stretched of said two portions of cable, said strands being anchored to the ends of said outer tubular envelope for ensuring precompression of said outer tubular envelope.

2. Apparatus according to claim 1, further comprising means disposed at the ends of said tubular envelope for anchoring said cable strands in relaive axial displacement from one another for limiting the deviation of said strands.

3. Apparatus according to claim 2, wherein seal means are included which surround said cable strands at the points where said strands exit from said anchoring means, said seal means allowing said tubular envelope to be filled under pressure with said cementitious material in its unhardened state.

4. Apparatus according to claim 1, wherein said segment of cable is curved, said cable strands in said segment of cable are helically arranged for minimizing differences in the lengths of said cable strands due to the curvature in said tubular envelope, said cable being maintained in helical arrangement by spacers located at regular intervals within said segment of cable.

5. Apparatus according to claim 1, wherein said segment of cable is connected to said massive constructive work and has relief elements mounted on its exterior surface to improve its connection with said massive constructive work.

6. Curvilinear cable segment apparatus for forming a connection between two rectilinear portions of a stretched cable, for transmitting tension from one of such cable portions to the other, said apparatus being adapted to pass through a massive bridge pylon or the like, comprising:

two rectilinear portions of a stretched cable;

a prestressed curvilinear tubular envelope having block means mounted on each end for connecting said envelope to said rectilinear cable portions;

a plurality of cable strands disposed within said tubular envelope and anchored at their ends within said block means, said strands being separated from one another by spacer means mounted inside said envelope;

said tubular envelope being substantially filled with a cured cementitious material; and said strands being stretched with a total tension force at least equal to that of the more stretched of said two rectilinear cable portions for ensuring precompression of said curvilinear tubular envelope when such stretching force on said strands is removed.

7. Apparatus according to claim 6, and further including a plurality of stacked discs disposed within said block means, said stacked discs having upper and lower sides adjacent to one another, and having substantially the same surface area on said adjacent sides, each disc being adapted to anchor a proportionate number of said cable strands therewithin, the remaining surface area of said discs helping to support adjacent discs.

8. Apparatus according to claim 6, said tubular envelope being connected to such bridge pylon or the like, and further including at least one relief element disposed on said tubular envelope for enhancing the connection of said tubular envelope to such pylon or the like.

9. Apparatus for connection between two rectilinear portions of a stretched cable, said apparatus being adapted to pass through a massive constructive work and to transmit tension from one of said portions of stretched cable to the other, said apparatus comprising:

a segment of cable including an outer tubular envelope containing a plurality of cable strands, said outer tubular envelope being filled, at least partly, with a hardened cementitious material, said strands being separated from one another and stretched with a total tension force at least equal to that of the more stretched of said two portions of cable, said strands being anchored to the ends of said outer tubular envelope for ensuring precompression of said outer tubular envelope;

said segment of cable being connected to said massive constructive work and having relief elements mounted on its exterior surface to improve its connection with said massive constructive work; and the ends of said tubular envelope being connected to said massive constructive work by elastomer sleeves for permitting relative displacement between said tubular envelope and said massive constructive work.

10. Curvilinear cable segment apparatus for connection between two rectilinear portions of a stretched cable, for transmitting tension from one of such cable portions to the other, said apparatus being adapted to pass through a massive bridge pylon or the like, comprising:

a curvilinear tubular envelope having block means mounted on each end for connecting said envelope to said rectilinear cable portions;

a plurality of cable strands disposed within said tubular envelope and anchored at their ends within said block means, said strands being separated from one another by spacer means mounted inside said envelope;

said tubular envelope being substantially filled with a cured cementitious material;

said strands being stretched with a total tension force at least equal to that of the more stretched of the two rectilinear cable portions for ensuring precompression of said curvilinear tubular envelope when such stretching force on said strands is removed;

said tubular envelope being connected to such bridge pylon or the like, and further including a least one relief element disposed on said tubular envelope for enhancing the connection of said tubular envelope to such pylon or the like; and the end portions of said tubular envelope being provided with elastomer sleeves disposed therearound between said tubular envelope and such pylon or the like for permitting relative displacement between said end portions of said tubular envelope and said pylon or the like.

* * * * *